US009658583B2

(12) United States Patent
Yotsutsuji et al.

(10) Patent No.: US 9,658,583 B2
(45) Date of Patent: May 23, 2017

(54) FIXING DEVICE AND IMAGE FORMING APPARATUS

(71) Applicant: KYOCERA Document Solutions Inc., Osaka (JP)

(72) Inventors: Takefumi Yotsutsuji, Osaka (JP); Yoshihiro Yamagishi, Osaka (JP); Takashi Eiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/945,871

(22) Filed: Nov. 19, 2015

(65) Prior Publication Data

US 2016/0154353 A1 Jun. 2, 2016

(30) Foreign Application Priority Data

Dec. 2, 2014 (JP) ..... 2014-243895

(51) Int. Cl.
*G03G 15/00* (2006.01)
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 15/2064; G03G 15/2042; G03G 15/2039
USPC ..... 399/329
See application file for complete search history.

(56) References Cited

U.S. PATENT DOCUMENTS 6,014,539 A * 1/2000 Sano ..... G03G 15/2053 219/216
6,031,215 A 2/2000 Nanataki et al.
7,937,027 B2 * 5/2011 Kato ..... F16C 33/201 399/121
8,865,306 B2 * 10/2014 Wu ..... G03G 15/162 399/121

(Continued)

FOREIGN PATENT DOCUMENTS

JP H09-319242 A 12/1997
JP 2010-107728 A 5/2010

(Continued)

OTHER PUBLICATIONS

An Office Action; "Notice of Reasons for Rejection," issued by the Japanese Patent Office on Sep. 27, 2016, which corresponds to Japanese Patent Application No. 2014-243895 and is related to U.S. Appl. No. 14/945,871.

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a fixing belt, a pressuring member, a pressing member, a shape restricting member and an elastic body. The fixing belt is configured to be rotatable. The pressuring member is configured to be rotatable and to come into pressure contact with the fixing belt so as to form a fixing nip. The pressing member is configured to press the fixing belt to a side of the pressuring member. The shape restricting member is configured to restrict a shape of the fixing belt and having an arc-shaped insertion part to be inserted into an end part of the fixing belt. The elastic body is attached to an end part in a circumferential direction of the insertion part.

10 Claims, 10 Drawing Sheets

(56) References Cited

U.S. PATENT DOCUMENTS

| | | | | |
|---|---|---|---|---|
| 2011/0318073 | A1* | 12/2011 | Arikawa | G03G 15/2032 399/329 |
| 2013/0183071 | A1 | 7/2013 | Iwaya et al. | |
| 2015/0063884 | A1 | 3/2015 | Iwaya et al. | |

FOREIGN PATENT DOCUMENTS

| | | | |
|---|---|---|---|
| JP | 2010-217517 | A | 9/2010 |
| JP | 2013-145288 | A | 7/2013 |

* cited by examiner

FIXING DEVICE AND IMAGE FORMING APPARATUS

INCORPORATION BY REFERENCE

This application is based on and claims the benefit of priority from Japanese Patent application No. 2014-243895 filed on Dec. 2, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet.

For example, there is a fixing device including a fixing belt, a pressuring member configured to come into pressure contact with the fixing belt so as to form a fixing nip and a shape restricting member having an insertion part that is inserted into an end part of the fixing belt.

In such a fixing device, in a case in which the insertion part of the shape restricting member is formed in an arc shape, there is a risk that contact of the fixing belt with the end part in a circumferential direction of the insertion part causes abrasion of the end part of the fixing belt, which leads to a break of the fixing belt. In addition, in a case in which an inner circumferential face of the fixing belt is coated, there is a risk that the coating is peeled by contact of the fixing belt with the end part in the circumferential direction of the insertion part.

SUMMARY

In accordance with an embodiment of the present disclosure, a fixing device includes a fixing belt, a pressuring member, a pressing member, a shape restricting member and an elastic body. The fixing belt is configured to be rotatable. The pressuring member is configured to be rotatable and to come into pressure contact with the fixing belt so as to form a fixing nip. The pressing member is configured to press the fixing belt to a side of the pressuring member. The shape restricting member is configured to restrict a shape of the fixing belt and has an arc-shaped insertion part to be inserted into an end part of the fixing belt. The elastic body is attached to an end part in a circumferential direction of the insertion part.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
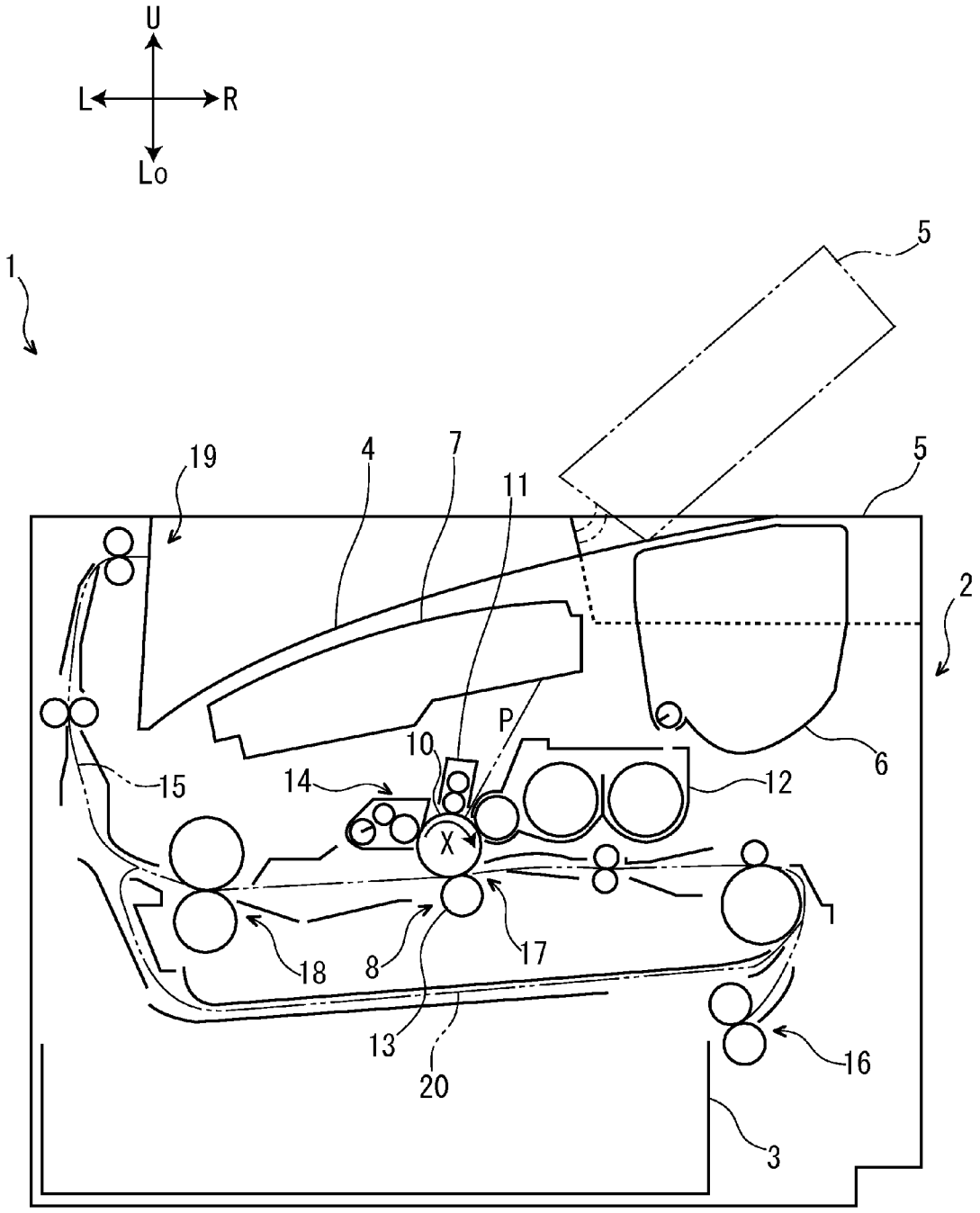
FIG. 1 is a schematic diagram showing a printer according to a first embodiment of the present disclosure.

First, with reference to FIG. 1, the entire structure of an electrographic printer 1 (an image forming apparatus) will be described. Hereinafter, it will be described so that the front side of the printer 1 is positioned at the front side of FIG. 1. Arrows Fr, Rr, L, R, U and Lo appropriately added to each of the drawings indicate the front side, rear side, left side, right side, upper side and lower side of the printer 1, respectively.

The printer 1 includes a box-formed printer main body 2. In a lower part of the printer main body 2, a sheet feeding cartridge 3 configured to store sheets (recording medium) is installed and, on the top surface of the printer main body 2, a sheet ejecting tray 4 is mounted. On the top surface of the printer main body 2, an upper cover 5 is openably/closably attached at a right side of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 19 to the sheet ejecting tray 4. Toner remained on the photosensitive drum 10 is collected by the cleaning device 14.

Next, the fixing device 18 will be described in detail with reference to FIGS. 2 to 6. Arrow Y in FIG. 2 indicates a sheet conveying direction. Arrow I in FIGS. 3 to 5 indicates an inside in front and rear directions, and arrow O in FIGS. 3 to 5 indicates an outside in the front and rear directions.

Figure 2:
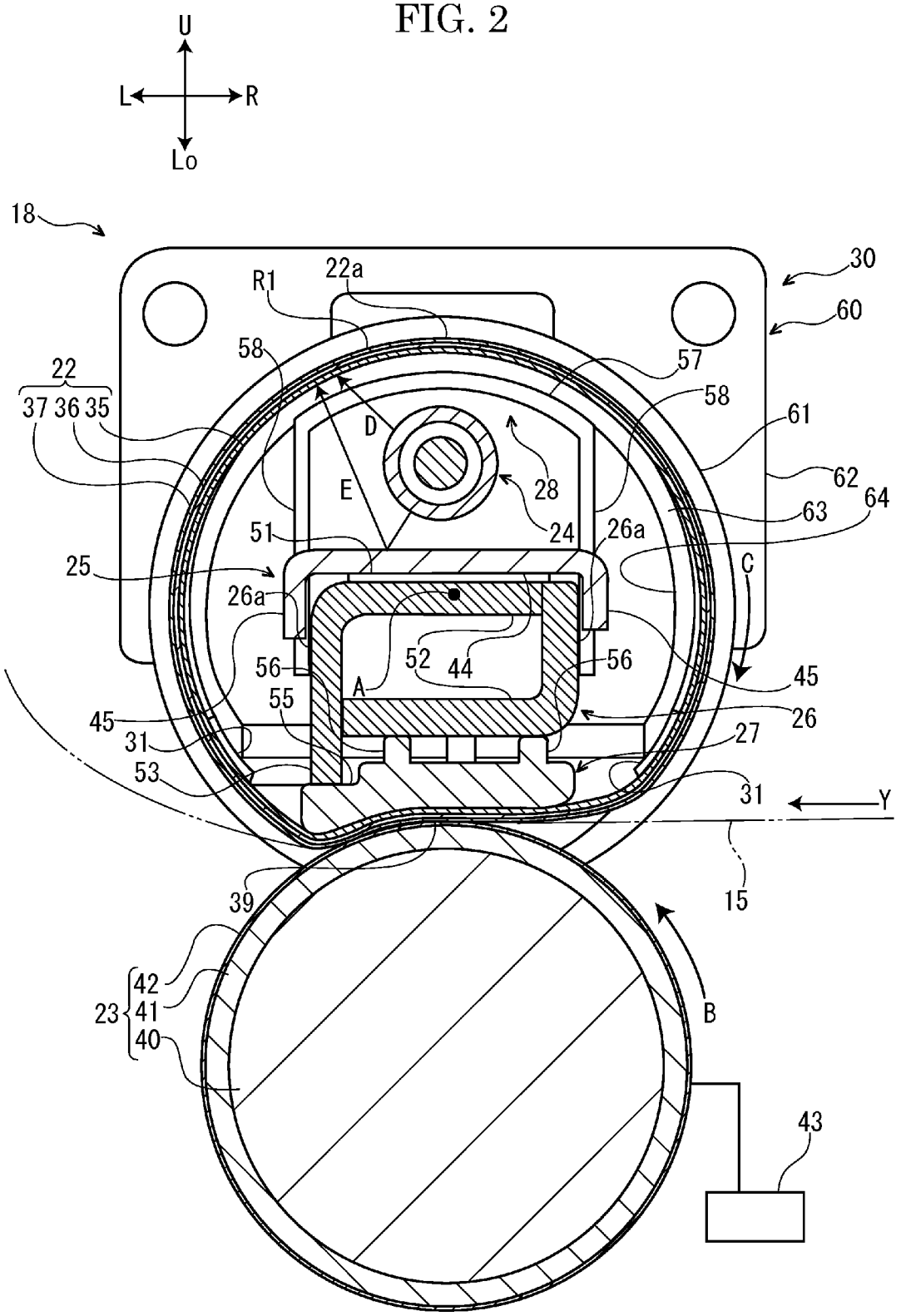
FIG. 2 is a sectional view showing a fixing device according to the first embodiment of the present disclosure.
Figure 3:
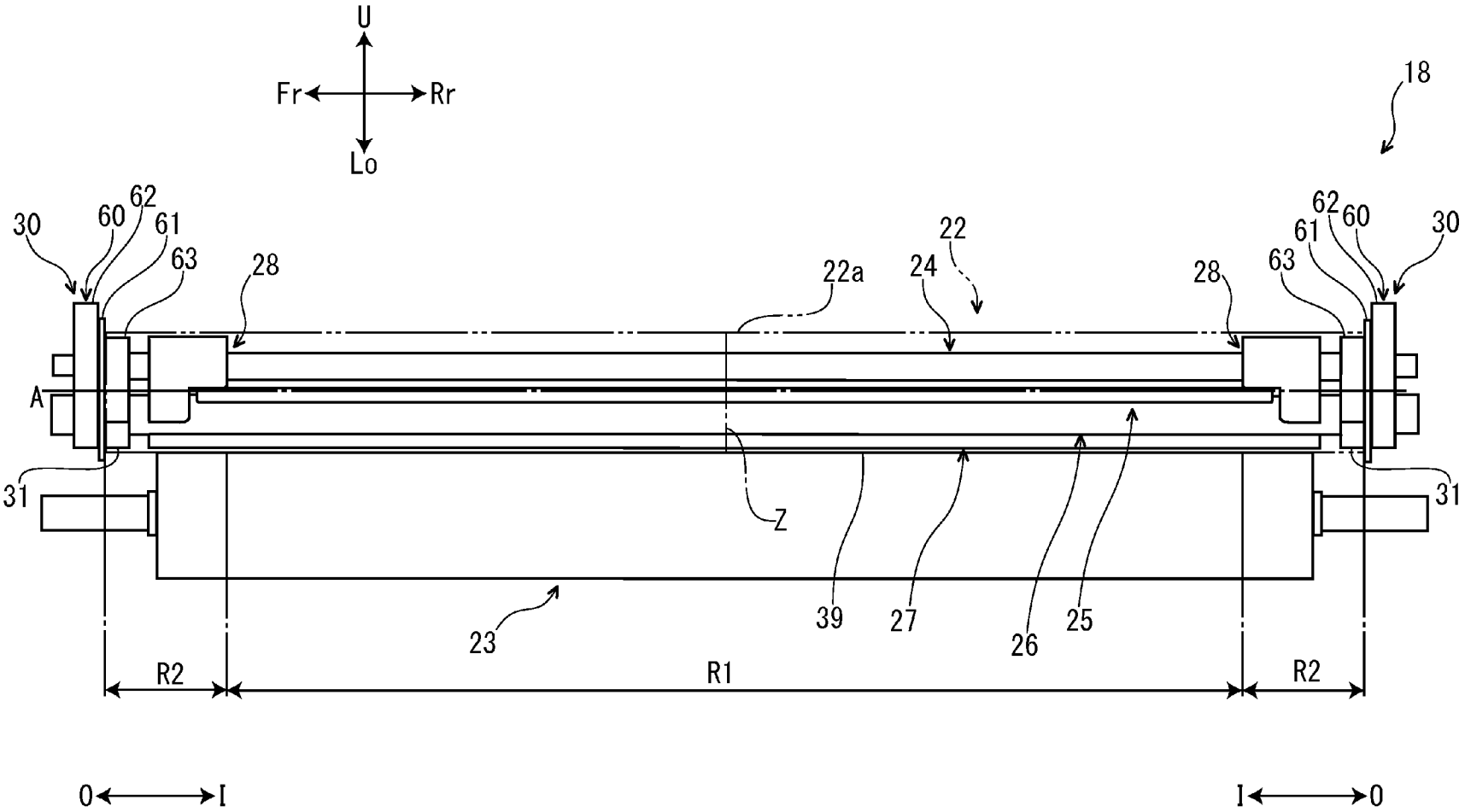
FIG. 3 is a side view showing the fixing device according to the first embodiment of the present disclosure.

As shown in FIGS. 2 and 3 and other figures, the fixing device 18 includes a fixing belt 22, a pressuring roller 23 (pressuring member) which is arranged below (outside) the fixing belt 22, a heater 24 (heat source) which is arranged at an inner diameter side of the fixing belt 22, a reflecting plate 25 (reflecting member) which is arranged at the inner diameter side of the fixing belt 22 and below the heater 24, a supporting member 26 which is arranged at the inner diameter side of the fixing belt 22 and below the reflecting plate 25, a pressing member 27 which is arranged at the inner diameter side of the fixing belt 22 and below the supporting member 26, cover members 28 which are fixed to both front and rear end parts of the supporting member 26 at the inner diameter side of the fixing belt 22, shape restricting members 30 which are attached to the both front and rear end parts of the fixing belt 22, and a pair of elastic bodies 31 which are attached to each shape restricting member 30. In addition, FIG. 3 is a perspective view of the inside of the fixing belt 22.

The fixing belt 22 is formed in a nearly cylindrical shape elongated in the front and rear directions. The fixing belt 22 is provided rotatably around a rotation axis A elongated in the front and rear directions. That is, in the present embodiment, the front and rear directions are a rotation axis direction of the fixing belt 22. The fixing belt 22 includes a sheet passing region R1 and non-sheet passing regions R2 which are provided at both front and rear sides (outsides in the front and rear directions) of the sheet passing region R1. The sheet passing region R1 is a region through which sheets of a maximum size pass. Each non-sheet passing region R2 is a region through which the sheets of the maximum size do not pass.

The fixing belt 22 has flexibility, and is endless in a circumferential direction. The fixing belt 22 includes a base material layer 35, an elastic layer 36 which is provided around this base material layer 35 and a release layer 37 which covers this elastic layer 36, for example. The base material layer 35 of the fixing belt 22 is made of a metal, such as SUS or nickel. In addition, the base material layer 35 of the fixing belt 22 may be made of a resin, such as PI (polyimide). The elastic layer 36 of the fixing belt 22 is made of a silicon rubber, for example. The thickness of the elastic layer 36 of the fixing belt 22 is 200 μm, for example. The release layer 37 of the fixing belt 22 is made of a PFA tube, for example. The thickness of the release layer 37 of the fixing belt 22 is 10 μm, for example. An inner circumferential face of the fixing belt 22 is coated in order to improve slidability and thermal absorptivity of the fixing belt 22.

The pressuring roller 23 is formed in a nearly columnar shape elongated in the front and rear directions. The pressuring roller 23 comes into pressure contact with the fixing belt 22 so as to form a fixing nip 39 between the fixing belt 22 and the pressuring roller 23. The pressuring roller 23 is rotatably provided. The pressuring roller 23 is connected to a drive source 43 constructed of a motor or the like.

The pressuring roller 23 includes a columnar core material 40, an elastic layer 41 which is provided around this core material 40 and a release layer 42 which covers this elastic layer 41, for example. The core material 40 of the pressuring roller 23 is made of a metal, such as iron. The elastic layer 41 of the pressuring roller 23 is made of a silicon rubber, for example. The release layer 42 of the pressuring roller 23 is made of a PFA tube, for example.

The heater 24 is configured as a halogen heater, for example. The heater 24 is arranged at an upper part (a part at a far side from the pressuring roller 23) in an internal space of the fixing belt 22, and is provided at a position displaced upward (the far side from the pressuring roller 23) from the rotation axis A of the fixing belt 22. Hence, in the present embodiment, an upper end part 22*a* of the fixing belt 22 is a part of the fixing belt 22 which is the closest to the heater 24.

The reflecting plate 25 is formed in a shape elongated in the front and rear directions. The reflecting plate 25 is made of a metal, such as an aluminum alloy for brightness. The reflecting plate 25 is arranged between the heater 24 and the supporting member 26. Across section of the reflecting plate 25 is formed in a U shape which protrudes upward (a far side from the pressuring roller 23).

The reflecting plate 25 includes a main body part 44 which is provided nearly horizontally, and guide parts 45 which are bent downward from both left and right end parts (end parts at an upstream side and a downstream side in the sheet conveying direction) of the main body part 44. A top face of the main body part 44 is a reflection face (mirror face) which faces the heater 24, and reflects radiation heat radiated from the heater 24, to an inner circumferential face of the fixing belt 22.

The supporting member 26 is formed in a shape elongated in the front and rear directions. An upper part of the supporting member 26 is inserted between the guide parts 45 of the reflecting plate 25. The supporting member 26 supports the reflecting plate 25 via a spacer 51, and is not in direct contact with the reflecting plate 25.

The supporting member 26 is formed by combining a pair of L-shaped sheet metals 52 made of SECC (galvanized steel plate) or the like, and has a nearly rectangular cross-sectional shape. At a lower left corner part of the supporting member 26, an engaging protrusion 53 which protrudes downward is formed. The engaging protrusion 53 is formed by elongating one of the sheet metals 52 downward. Both side walls 26*a* of the supporting member 26 extend along upper and lower directions and are provided in parallel each other.

The pressing member 27 is formed in a long flat shape in the front and rear directions. The pressing member 27 is made of a heat-resistant resin, such as an LCP (Liquid Crystal Polymer). At a left end part of a top face of the pressing member 27, an engaging convex part 55 is formed. The engaging convex part 55 engages with the engaging protrusion 53 of the supporting member 26. In the top face of the pressing member 27, a plurality of bosses 56 are protruded. An upper end part of each boss 56 comes into contact with a lower face of the supporting member 26. According to the above-mentioned configuration, the supporting member 26 supports the pressing member 27, and restricts a warp of the pressing member 27.

A left side part (a part at a downstream side in the sheet conveying direction) of the lower face of the pressing member 27 is inclined downward (toward the pressuring roller 23) from the right side (an upstream side in the sheet conveying direction) to the left side (the downstream side in the sheet conveying direction). The lower face of the pressing member 27 presses the fixing belt 22 downward (toward the pressuring roller 23).

Each cover member 28 is formed in a nearly U shape when seen from a front view. A position in the front and rear directions of each cover member 28 meets each non-sheet passing region R2 of the fixing belt 22 and each cover member 28 has a function of blocking the radiation heat from the heater 24 to each non-sheet passing region R2 of the fixing belt 22.

Each cover member 28 includes a curved part 57 which is curved upward in an arc shape, and attachment parts 58 which are bent downward from both left and right end parts (end parts at the upstream side and the downstream side in the sheet conveying direction) of the curved part 57. The curved part 57 is arranged along the inner circumferential face of the fixing belt 22. A lower end part of each attachment part 58 is attached to each one of both left and right side faces of the supporting member 26.

Each shape restricting member 30 is arranged closer to the outside in the front and rear directions than each cover member 28. Each shape restricting member 30 includes a restricting piece 60 and a ring piece 61 which is attached to the restricting piece 60.

The restricting piece 60 of each shape restricting member 30 includes a base part 62, and an insertion part 63 which is protruded on a face at the inside in the front and rear directions of the base part 62.

Figure 4:
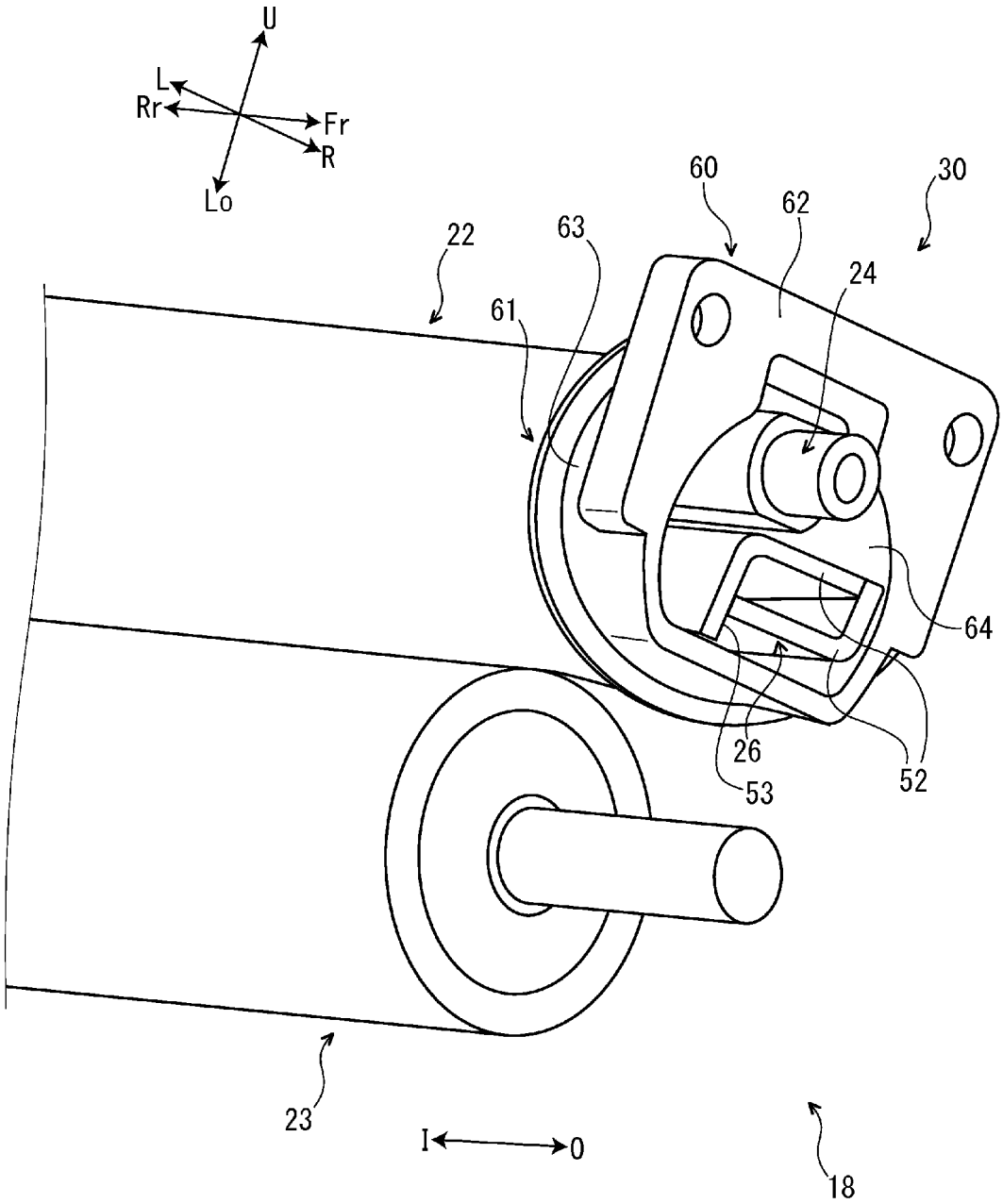
FIG. 4 is a perspective view showing a front end part of the fixing device according to the first embodiment of the present disclosure.

As shown in FIG. 4 and other figures, a through-hole 64 which penetrates the base part 62 and the insertion part 63 is provided at the restricting piece 60 of each shape restricting member 30 along the front and rear directions, and the heater 24 and the supporting member 26 penetrate this through-hole 64.

Figure 5:
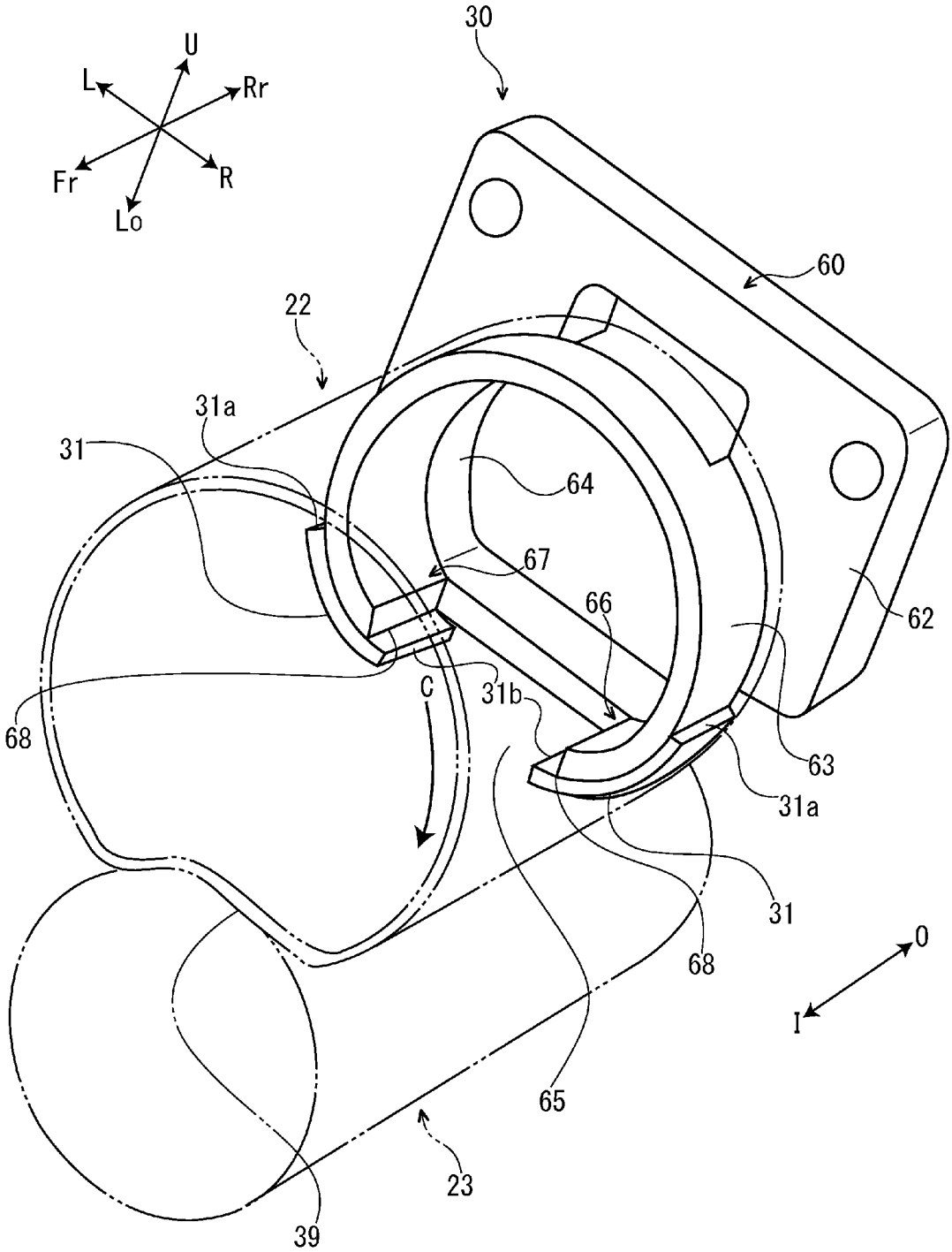
FIG. 5 is a perspective view showing a shape restricting member and an elastic body in the fixing device according to the first embodiment of the present disclosure.

As shown in FIG. 5, 6 and other figures, the insertion part 63 of the restricting piece 60 of each shape restricting member 30 is curved along an outer circumference of the through-hole 64, and is formed in a nearly arc shape (downward C shape). The insertion part 63 is inserted into the both front and rear end parts of the fixing belt 22. Consequently, the shape of the fixing belt 22 is restricted (deformation of the fixing belt 22 is prevented). The insertion part 63 has a notch 65 formed at a lower position thereof (a position corresponding to that of the fixing nip 39 in the circumferential direction). At a right side of the notch 65 (an upstream side in the rotation direction C of the fixing belt), an upstream side end part 66 (an end part in a circumferential direction) of the insertion part 63 is formed. At a left side of the notch 65 (a downstream side in the rotation direction C of the fixing belt 22), a downstream side end part 67 (an end part in a circumferential direction) of the insertion part 63 is formed. That is, the upstream side end part 66 and the downstream side end part 67 of the insertion part 63 face each other across the notch 65.

As shown in FIG. 4 and other figures, the ring piece 61 of each shape restricting member 30 is formed in an annular shape. The ring piece 61 is attached to an outer circumference of the insertion part 63 of the restricting piece 60. The ring piece 61 is arranged at the outside in the front and rear directions of the both front and rear end parts of the fixing belt 22, and restricts meandering (movement to the outside in the front and rear directions) of the fixing belt 22. The upper part of the ring piece 61 is arranged at the inside in the front and rear directions of the base part 62 of the restricting piece 60, and thereby restricts movement of the ring piece 61 to the outside in the front and rear directions. In addition, in FIG. 5 and the following drawings, description of the ring piece 61 is omitted.

Each elastic body 31 is made of a material having a lower thermal conductivity such as, for example, a silicon rubber and NBR (nitrile rubber). That prevents thermal conduction from the fixing belt 22 to each elastic body 31.

Figure 6:
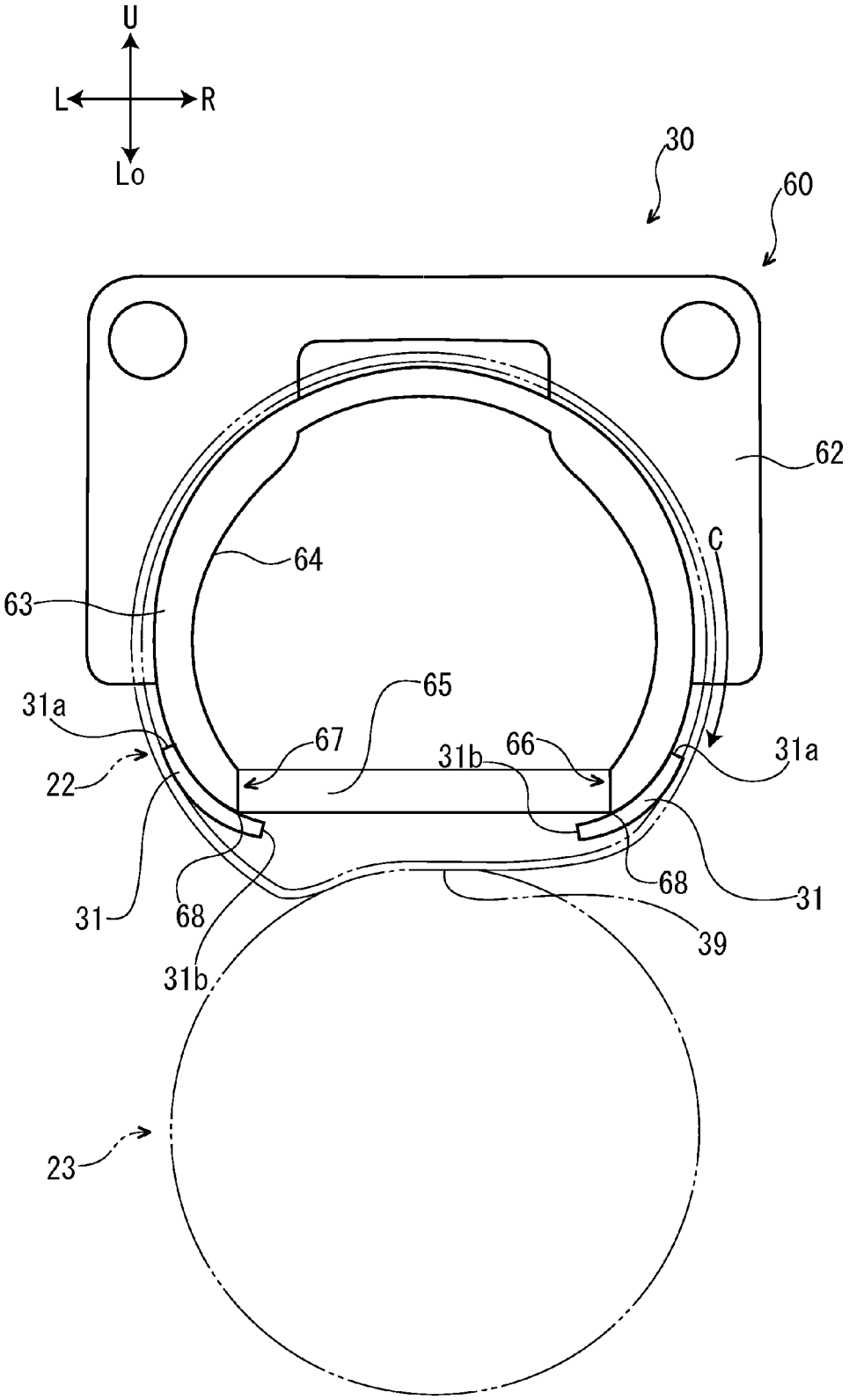
FIG. 6 is a front view showing the shape restricting member and the elastic body in the fixing device according to the first embodiment of the present disclosure.

As shown in FIGS. 5, 6 and other figures, each elastic body 31 is attached to the upstream side end part 66 and the downstream side end part 67 (hereinafter, referred to as "both end parts 66 and 67 in the circumferential direction") of the insertion part 63 of the restricting piece 60 of each shape restricting member 30, and covers edge parts 68 formed in both end parts 66 and 67 in the circumferential direction of the insertion part 63. Each elastic body 31 is adhered (fixed) on the outer circumferential face of both end parts 66 and 67 in the circumferential direction of the insertion part 63, and is sandwiched between both end parts of the fixing belt 22 and both end parts 66 and 67 in the circumferential direction of the insertion part 63. Each elastic body 31 is arcuately curved along the circumferential direction of the insertion part 63 over the entire region from a base end portion 31*a* to a tip end portion 31*b*. The tip end portion 31*b* of each elastic body 31 protrudes toward an inner side in the right and left directions (a side of the notch 65) of the both end parts 66 and 67 in the circumferential direction of the insertion part 63.

In the fixing device 18 as configured above, when a toner image is fixed on a sheet, the drive source 43 rotates the pressuring roller 23 (see an arrow B in FIG. 2). When the pressuring roller 23 is rotated in such a way, the fixing belt 22 coming into pressure contact with the pressuring roller 23 is co-rotated in a reverse direction to that of the pressuring roller 23 (see an arrow C in FIG. 2). When the fixing belt 22 is rotated in such a way, the fixing belt 22 slides along the pressing member 27.

Further, when a toner image is fixed on a sheet, the heater 24 is operated. When the heater 24 is operated in this way, the heater 24 radiates radiation heat. A part of the radiation heat radiated from the heater 24 is directly radiated on and is absorbed in the inner circumferential face of the fixing belt 22 as indicated by arrow D in FIG. 2. Further, as indicated by arrow E in FIG. 2, another part of the radiation heat radiated from the heater 24 is reflected toward the inner circumferential face of the fixing belt 22 by the top face of the main body part 44 of the reflecting plate 25, and is absorbed in the inner circumferential face of the fixing belt 22. According to the above-mentioned function, the heater 24 heats the fixing belt 22. When the sheet passes through the fixing nip 39 in this state, the toner image is heated, is melted and is fixed on the sheet.

By the way, in the present embodiment, as described above, the insertion part 63 of the restricting piece 60 of each shape restricting member 30 is formed in an arc shape. Accordingly, when the fixing belt 22 is rotated as described above, there is a risk that both front and rear end parts of the fixing belt 22 are abraded by contact with the both end parts 66 and 67 in the circumferential direction (particularly, edge parts 68) of the insertion part 63, which leads to a break of the fixing belt 22. In addition, there is another risk that coating applied on the inner circumferential face of the fixing belt 22 is peeled by contact with the both end parts 66 and 67 in the circumferential direction of the insertion part 63.

However, in the present embodiment, as described above, since each elastic body 31 is attached to the both end parts 66 and 67 in the circumferential direction of the insertion part 63, the both front and rear end parts of the fixing belt 22 are less likely to come into contact with the both end parts 66 and 67 in the circumferential direction of the insertion part 63. According to this, it become possible to prevent abrasion of the both front and rear end parts of the fixing belt 22 by contact with the both end parts 66 and 67 in the circumferential direction of the insertion part 63, and to prevent a break of the fixing belt 22. In addition, it becomes possible to prevent peeling of the coating applied on the inner circumferential face of the fixing belt 22 by contact with the both end parts 66 and 67 in the circumferential direction of the insertion part 63.

In addition, in the present embodiment, a configuration in which the fixing belt 22 is co-rotated with the rotation of the pressuring roller 23 is employed. When such a configuration is employed, in a right side region of the fixing nip 39 (an upstream side region in the rotation direction C of the fixing belt 22), the fixing belt 22 is pulled to the fixing nip 39 side. Hence, a load (a pressure) applied to the fixing belt 22 is higher than that in a left side region of the fixing nip 39 (a downstream side region in the rotation direction C of the fixing belt 22). According to this, in a right side region of the notch 65 (an upstream side region in the rotation direction C of the fixing belt 22), compared with a left side region of the notch 65 (a downstream side region in the rotation direction C of the fixing belt 22), a load (a pressure) applied to the both front and rear end parts of the fixing belt 22 is higher, which may cause a break of the fixing belt.

On this point, in the present embodiment, a higher load applied to both front and rear end parts of the fixing belt 22 at the right side region of the notch 65 can be absorbed by the elastic body 31 attached to the upstream side end part 66 of the insertion part 63. According to this, the abrasion of both front and rear end parts of the fixing belt 22 can be effectively prevented.

Further, each elastic body 31 is fixed on the outer circumferential face of the both end parts 66 and 67 in the circumferential direction of the insertion part 63. By employing such a configuration, compared with a case in which each elastic body 31 is fixed on the inner circumferential face of the both end parts 66 and 67 in the circumferential direction of the insertion part 63, it is easy to prevent contact of the both end parts 66 and 67 in the circumferential direction of the insertion part 63 with the both front and rear end parts of the fixing belt 22. Therefore, the abrasion of the both front and rear end parts of the fixing belt 22 by the contact with the both end parts 66 and 67 in the circumferential direction of the insertion part 63 can be effectively prevented.

In the present embodiment, a case in which each elastic body 31 is attached to the both end parts 66 and 67 in the circumferential direction of the insertion part 63 of the restricting piece 60 of each shape restricting member 30 has been described. On the other hand, in other different embodiments, an elastic body 31 may be attached to either one of the both end parts 66 and 67 in the circumferential direction of the insertion part 63 of the restricting piece 60 of each shape restricting member 30.

In the present embodiment, a case in which each shape restricting member 30 includes the restricting piece 60 and the ring piece 61 has been described. On the other hand, in other different embodiments, each shape restricting member 30 may include only a restricting piece 60, and may not include a ring piece 61.

In the present embodiment, a case where the heater 24 composed of the halogen heater is used as a heat source has been described. Meanwhile, in the other different embodiments, a ceramic heater or the like may be used as the heat source.

In the present embodiment, a case where the configuration of the present disclosure is applied to the printer 1 has been described. Meanwhile, in the other different embodiments, the configuration of the disclosure may be applied to another image forming apparatus, such as a copying machine, a facsimile or a multifunction peripheral.

Second Embodiment

Figure 7:
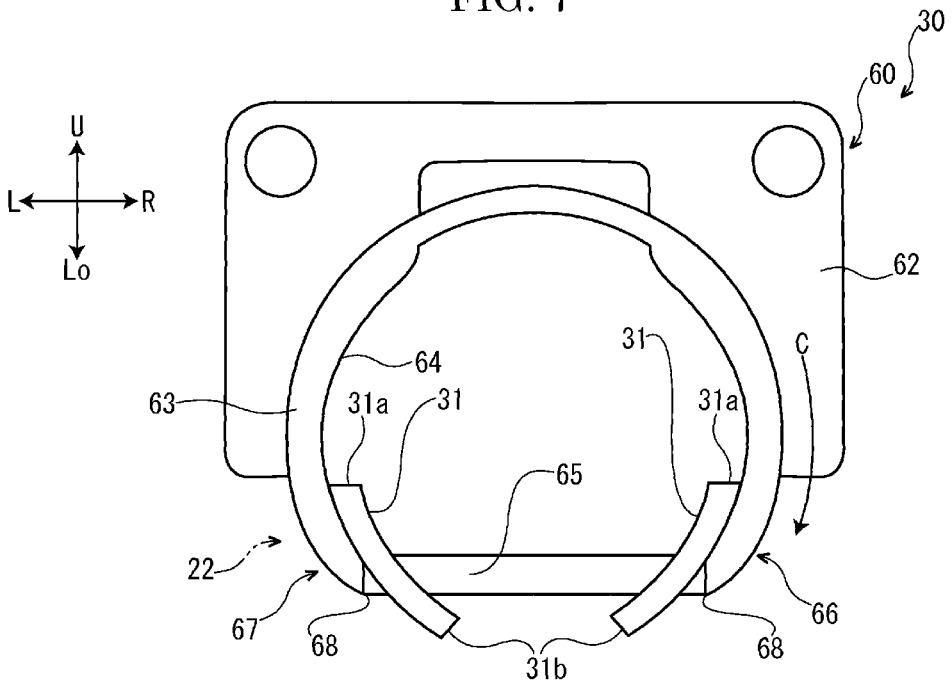
FIG. 7 is a front view showing a shape restricting member and an elastic body in a fixing device according to a second embodiment of the present disclosure.

In the first embodiment, each elastic body 31 was fixed on the outer circumferential face of the both end parts 66 and 67 in the circumferential direction of the insertion part 63. To the contrary, in a second embodiment, as shown in FIG. 7, each elastic body 31 is fixed on the inner circumferential face of the both end parts 66 and 67 in the circumferential direction of the insertion part 63.

Third Embodiment

Figure 8:
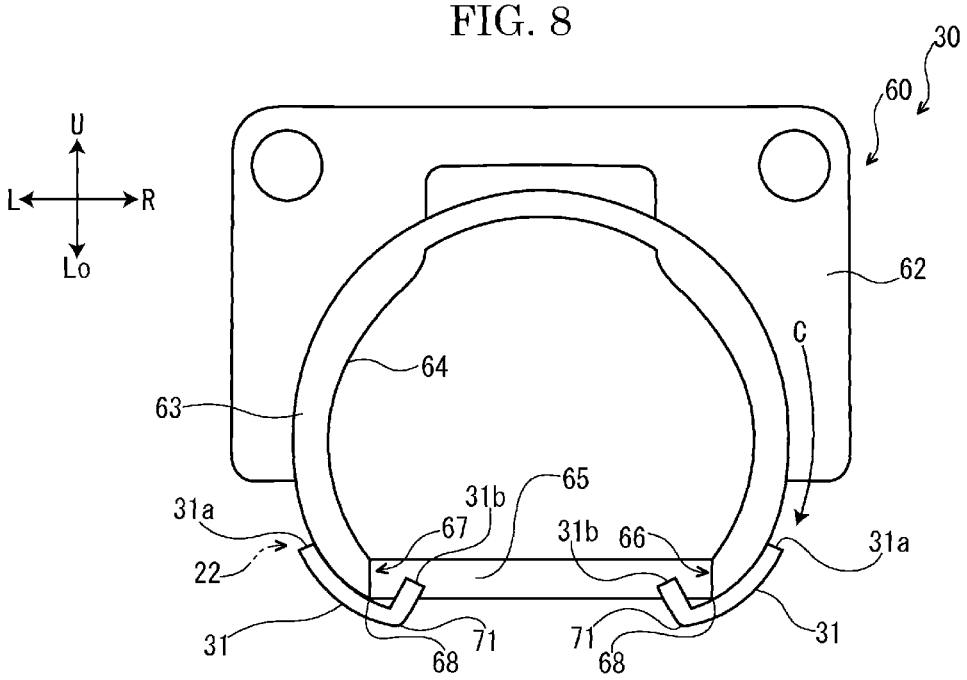
FIG. 8 is a front view showing a shape restricting member and an elastic body in a fixing device according to a third embodiment of the present disclosure.

Each elastic body 31 according to the first embodiment was arcuately curved along the circumferential direction of the insertion part 63 over the entire region from the base end portion 31*a* to the tip end portion 31*b*. In other words, each elastic body 31 in the first embodiment had no bent parts. To the contrary, each elastic body 31 in a third embodiment, as shown in FIG. 8, includes a bent part 71 at a tip side portion of a portion fixed on the outer circumferential face of the both end parts 66 and 67 in the circumferential direction of the insertion part 63, and at the bent part 71, each elastic body 31 is bent toward an upper side (inner diameter side of the insertion part 63). By employing such a configuration, the abrasion of the both front and rear end parts of the fixing belt 22 by contact with the tip end portion 31*b* of each elastic body 31 can be prevented.

Fourth Embodiment

Figure 9:
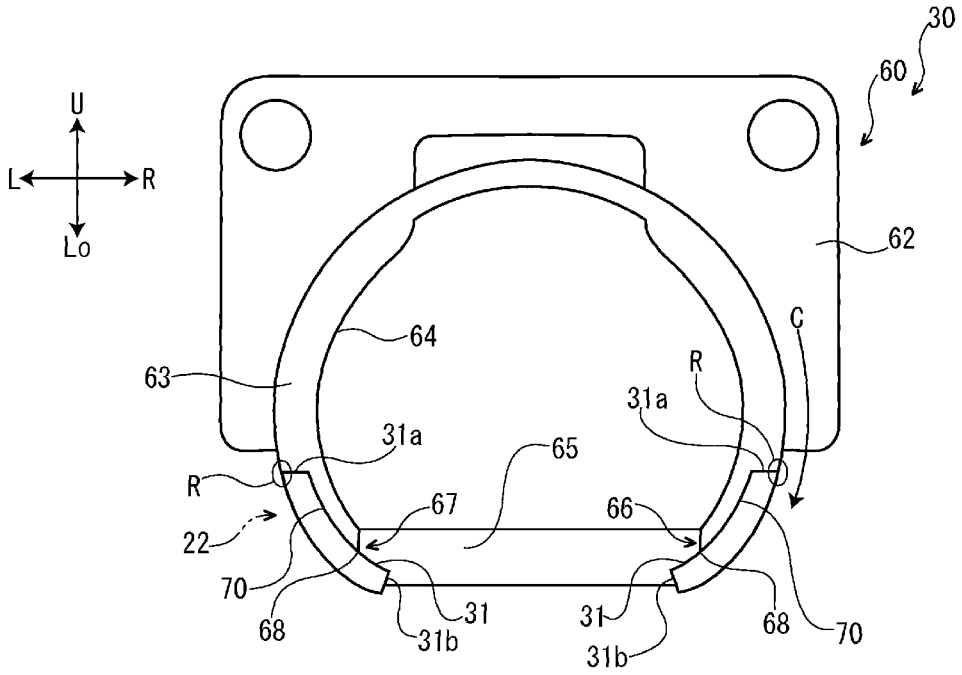
FIG. 9 is a front view showing a shape restricting member and an elastic body in a fixing device according to a fourth embodiment of the present disclosure.

In the first embodiment, the outer circumferential face of the both end parts 66 and 67 in the circumferential direction of the insertion part 63 did not have any depressions. To the contrary, in a fourth embodiment, as shown in FIG. 9, depressions 70 are provided on the outer circumferential face of the both end parts 66 and 67 in the circumferential direction of the insertion part 63, and each elastic body 31 is fitted into the depressions 70. By employing such a configuration, compared with a case in which the depressions 70 are not provided, a gap generated between the outer circumferential face of the insertion part 63 and the base end portion 31*a* of each elastic body 31 can be narrowed. According to this, the abrasion of the both front and rear end parts of the fixing belt 22 by contact with the base end portion 31*a* of each elastic body 31 can be prevented.

Particularly in the present embodiment, the outer circumferential face of the insertion part 63 is flush with the base end portion 31*a* of the each elastic body 31 (see R portion in FIG. 9). In other words, there is no gap between the outer circumferential face of the insertion part 63 and the base end portion 31*a* of each elastic body 31. Therefore, the abrasion of the both front and rear end parts of the fixing belt 22 by contact with the base end portion 31*a* of each elastic body 31 can be further effectively prevented.

In addition, by fitting each elastic body 31 into the depression 70 as described above, each elastic body 31 can be easily fixed on the both end parts 66 and 67 in the circumferential direction of the insertion part 63 without using any fixing methods such as adhering.

Fifth Embodiment

Figure 10:
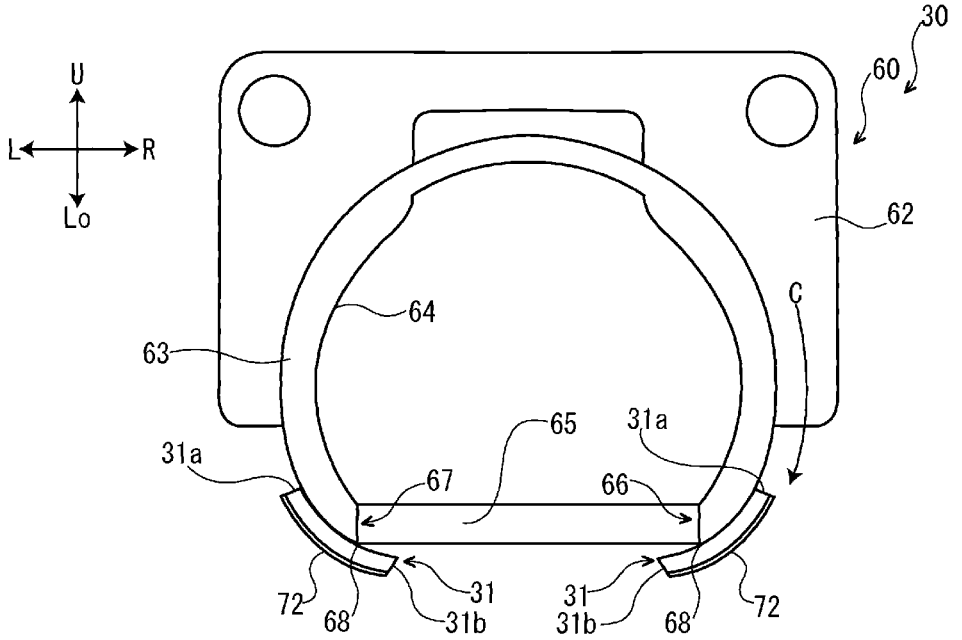
FIG. 10 is a front view showing a shape restricting member and an elastic body in a fixing device according to a fifth embodiment of the present disclosure.

In the first embodiment, the surface of each elastic body 31 was exposed. To the contrary, in a fifth embodiment, as shown in FIG. 10, the surface of each elastic body 31 is coated by a coating layer 72. The coating layer 72 is formed with a material having a lower coefficient of friction than that of each elastic body 31 (for example, fluorine-based resins such as PTFE). By employing such a configuration, the abrasion of the both front and rear end parts of the fixing belt 22 can be further effectively prevented.

<Comparative Experiment>

With respect to the fixing device according to comparative example (the fixing device in which elastic bodies 31 are not attached to the both end parts 66 and 67 in the circumferential direction of the insertion part 63) and fixing devices 18 according to the first to fifth embodiments, the number of printed sheets when the fixing belt 22 was broken (K sheets=1000 sheets) was counted. In addition, the counting was finished when 200K sheets was counted even when the fixing belt 22 was not broken.

Figure 11:
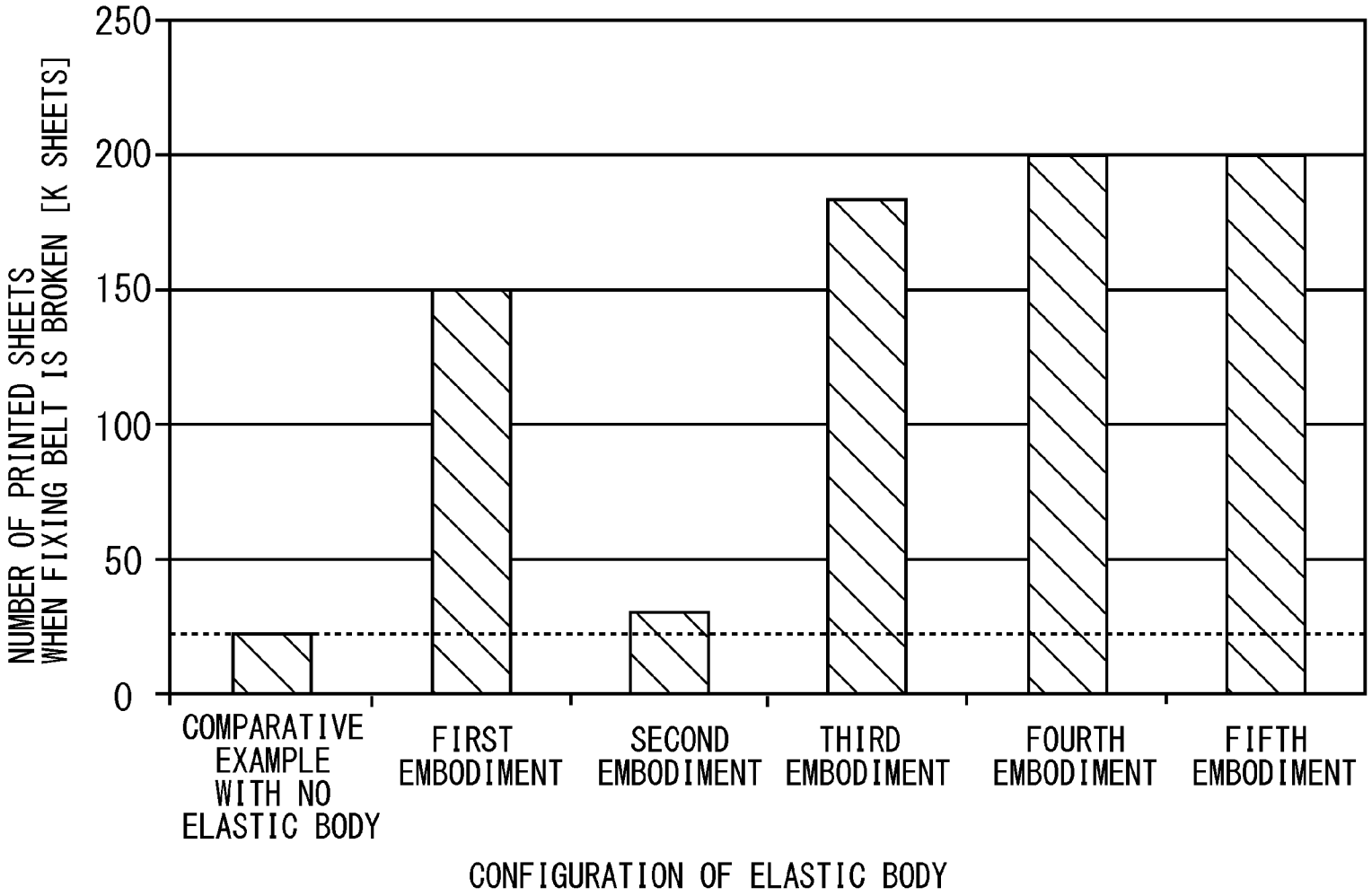
FIG. 11 is a graph showing a relationship between the configuration of the elastic body and the number of printed sheets when the fixing belt is broken.

As shown in FIG. 11, in the fixing devices 18 according to the first to fifth embodiments, compared with the fixing device according to comparative example, the number of printed sheets when the fixing belts 22 were broken is large. This reveals that the fixing devices 18 according to the first to fifth embodiments, compared with the fixing device according to comparative example, the fixing belts 22 are less likely to break. Particularly, this reveals that in a case in which each elastic body 31 is fixed on the outer circumferential face of the both end parts 66 and 67 in the circumferential direction of the insertion part 63 (the first, third to fifth embodiments), compared with the fixing device according to comparative example, the fixing belts 22 are extremely less likely to break.

<Young's Modulus of Elastic Body 31>

Next, with reference to FIG. 12, the range in which the Young's modulus of the elastic body 31 can be set will be described.

When the Young's modulus of the elastic body 31 is less than 10 MPa, there is a risk that the amount of displacement of the fixing belt 22 exceeds the tolerance limit (1.0 mm), the fixing belt 22 may come into contact with members arranged around the fixing belt 22 (for example, a separating member for separating a sheet from the fixing belt 22 and/or a thermistor for detecting the temperature of the fixing belt 22). On the other hand, when the Young's modulus of the elastic body 31 exceeds 23 MPa, the maximum stress applied to the fixing belt 22 exceeds the tolerance limit (800 MPa), the fixing belt 22 may be broken. Accordingly, when the Young's modulus E of the elastic body 31 satisfies a relation 10 Mpa≤E≤23 Mpa, the amount of displacement of the fixing belt 22 can be restricted within a predetermined range while a stress that exceeds the tolerance limit is prevented from being applied to the fixing belt 22.

Figure 12:
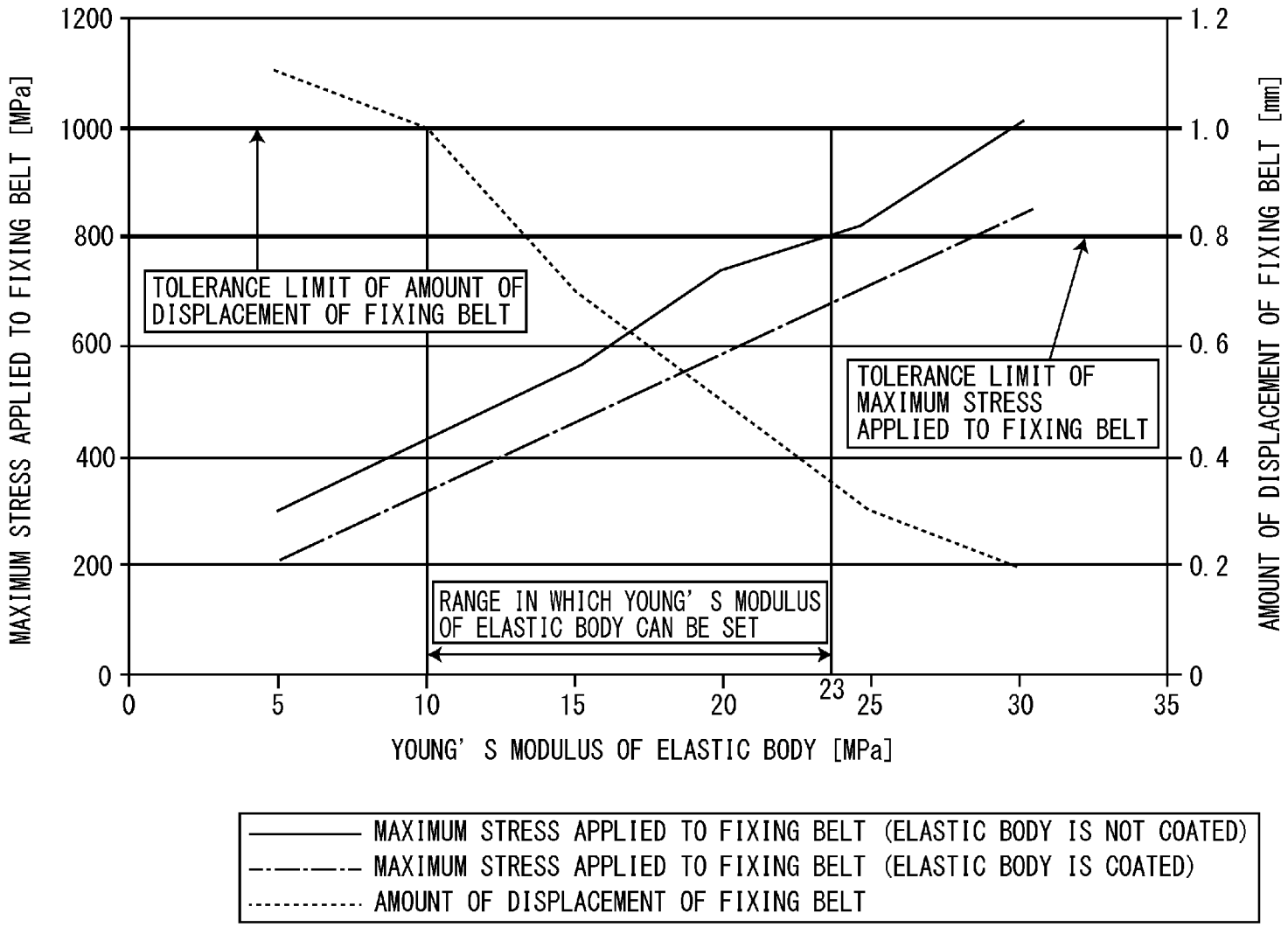
FIG. 12 is a graph showing a range in which the Young's modulus of the elastic body can be set.

In addition, as shown in FIG. 12, in a case in which the surface of the elastic body 31 is coated (see the fifth embodiment), compared with a case in which the surface of the elastic body 31 is not coated (see the first embodiment), the maximum stress applied to the fixing belt 22 can be decreased. According to this, the range in which the Young's modulus of the elastic body 31 can be set can be lengthened.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable;

a pressuring member configured to be rotatable and to come into pressure contact with the fixing belt so as to form a fixing nip;

a pressing member configured to press the fixing belt to a side of the pressuring member;

a shape restricting member configured to restrict a shape of the fixing belt and having an arc-shaped insertion part to be inserted into an end part of the fixing belt; and an elastic body attached to an end part in a circumferential direction of the insertion part, wherein a Young's modulus E of the elastic body satisfies a relation "10 Mpa≤E≤23 Mpa".

2. The fixing device according to claim 1, wherein the insertion part has a notch formed at a position corresponding to that of the fixing nip in the circumferential direction, wherein end parts in the circumferential direction of the insertion part include:

an upstream side end part formed at an upstream side of the notch in a rotation direction of the fixing belt; and a downstream side end part formed at a downstream side of the notch in the rotation direction of the fixing belt, and wherein the elastic body is attached to at least the upstream side end part.

3. The fixing device according to claim 1, wherein the elastic body is fixed on an outer circumferential face of the end part in the circumferential direction of the insertion part.

4. The fixing device according to claim 3, wherein the outer circumferential face of the end part in the circumferential direction of the insertion part has a depression into which the elastic body can be fitted.

5. The fixing device according to claim 3, wherein the surface of the elastic body is coated with a material having a lower coefficient of friction than that of the elastic body.

6. The fixing device according to claim 3, wherein the elastic body is bent toward an inner diameter side of the insertion part at a tip side portion of a portion fixed on the outer circumferential face of the end part in the circumferential direction of the insertion part.

7. The fixing device according to claim 1, wherein the elastic body is fixed on an inner circumferential face of the end part in the circumferential direction of the insertion part.

8. The fixing device according to claim 1, wherein the fixing belt is configured to be rotatable around a rotation axis, wherein the shape restricting member includes:

a restricting piece having the insertion part; and a ring piece attached to the restricting piece, and positioned outside in the direction of the rotation axis of the end part of the fixing belt.

9. The fixing device according to claim 8, further comprising a heat source configured to heat the fixing belt, wherein the restricting piece has a through hole formed along a direction of the rotation axis, and the heat source penetrates the through hole.

10. An image forming apparatus comprising the fixing device according to claim 1.

* * * * *